United States Patent [19]

Dickerson

[11] Patent Number: 4,484,829

[45] Date of Patent: Nov. 27, 1984

[54] PROTECTIVE DIRECTORY COVER

[76] Inventor: Robert W. Dickerson, 34 Glenview Dr., Cromwell, Conn. 06416

[21] Appl. No. 434,926

[22] Filed: Oct. 18, 1982

[51] Int. Cl.[3] ..... B42F 3/00; B42D 3/00

[52] U.S. Cl. ..... 402/70; 281/29

[58] Field of Search ..... 281/29; 283/4, 3, 5, 283/6, 7; 402/70

[56] References Cited

U.S. PATENT DOCUMENTS

| | | | |
|---|---|---|---|
| 1,426,657 | 8/1922 | Long | 281/29 |
| 1,519,610 | 12/1924 | Franz, Jr. | 281/29 |
| 3,190,678 | 6/1965 | Peterson et al. | 281/29 |
| 3,199,895 | 8/1965 | De Tullio | 281/29 |
| 3,617,074 | 11/1972 | Ragolini et al. | 281/29 |
| 4,108,473 | 8/1978 | Coen et al. | 281/29 |

FOREIGN PATENT DOCUMENTS

| | | | |
|---|---|---|---|
| 611581 | 2/1926 | France | 281/29 |
| 221947 | 9/1942 | Switzerland | 281/29 |
| 552787 | 12/1942 | United Kingdom | 281/29 |

*Primary Examiner*—Robert L. Spruill
*Assistant Examiner*—Paul M. Heyrana, Sr.

[57] ABSTRACT

A cover assembly for protectively mounting a telephone directory utilizes a cover member that is integrally formed from a single sheet of thermoplastic material. The cover member is so constructed as to ensure good ventilation while preventing the entrance of rain thereinto, thereby protecting the directory against deterioration from weather conditions as well as against abuse.

5 Claims, 3 Drawing Figures

PROTECTIVE DIRECTORY COVER

BACKGROUND OF THE INVENTION

Directories provided at telephone booths and other such public facilities are normally bound within tough and durable supplemental covers, to protect the directory against abuse and weather conditions. The supplemental cover is normally semi-permanently attached to part of the booth or other available structure, thus also serving to discourage removal and theft of the directory. Such covers take a variety of forms; some are injection molded from a suitable thermoplastic material, while others consist of rigid front and rear cover panels attached to a metal spine portion, a piano-type hinge typically being used to join the parts.

In many instances, such prior art protective covers have been inordinately expensive. Moreover, they have often been inadequate for their intended purpose, tending to break at the hinges or otherwise becoming ineffective after relatively short periods of use. Furthermore, there appears to have been little if any appreciation for the importance of providing air circulation through such a cover, to maintain the directory in good condition.

Accordingly, it is a primary object of the present invention to provide a novel protective cover assembly for a telephone directory or like volume, which is so constructed as to minimize the entry of rain and other forms of precipitation while, at the same time, providing good ventilation for the directory contained therewithin.

It is also an object of the invention to provide such a novel assembly which affords a high degree of protection against abuse, and which is itself tough and durable.

Another object of the invention is to provide an assembly having the foregoing features and advantages, which is also of relatively simple design, and is fascile and inexpensive to produce.

SUMMARY OF THE INVENTION

It has now been found that the foregoing and related objects of the invention are readily attained in a protective cover assembly including a one-piece cover member, and a mounting member affixed therewithin. The cover member is integrally formed from a sheet of relatively rigid thermoplastic material, and is comprised of a front cover, a rear cover, and a spine extending between the covers and hingedly connected thereto. Each of the covers comprises a panel portion dimensioned and configured to overlie a cover of the mounted directory, and a pair of flange portions disposed at the opposite ends of the panel portion. The flange portions at each end of the assembly extend toward one another from the associated panel portion, into overlapping relationship when the covers are in a closed position about the directory, to thereby cooperatively overlie the top and bottom edges thereof. The inner ends of the cooperating flange portions are configured to define a ventilation opening adjacent each end of the spine, to facilitate air circulation through the assembly. The mounting member is affixed to the spine of the cover member, and the latter has a shield piece projecting outwardly from each end thereof, to a position substantially over the adjacent ventilation opening. The shield pieces prevent the direct entry of rain and other precipitation into the corresponding opening, without blocking the free flow of air therethrough.

In the preferred embodiments, each of the flange portions of the covers is defined by the fold line along which it is joined to the panel portion, in cooperation with a shorter rectilinear leading edge extending generally parallel thereto, an inner edge at the inner end, which extends at an acute angle to the fold line, and an outer edge at the outer end thereof. When the covers are in a closed position the inner edges of the cooperating flange portions intersect at points spaced from the spine, to define the ventilation openings. Generally, the shield pieces will be substantially flat tabs, and will project at an angle of about 45° to the plane of the spine.

The mounting member utilized in the assembly may advantageously comprise an elongated fixture extending along the spine and presenting an abutment surface for the spine of the directory, and will include at least one longitudinal retaining component secured to the ends of the fixture to maintain the directory thereagainst. The assembly may additionally include a hanger member secured to the outer surface of the spine, for supporting the assembly from above. The material of fabrication will advantageously be a high density polyethylene, with the flange portions and the hinges of the cover member being produced by deforming the sheet under heat and pressure.

DETAILED DESCRIPTION OF THE ILLUSTRATED EMBODIMENT

Figure 1:
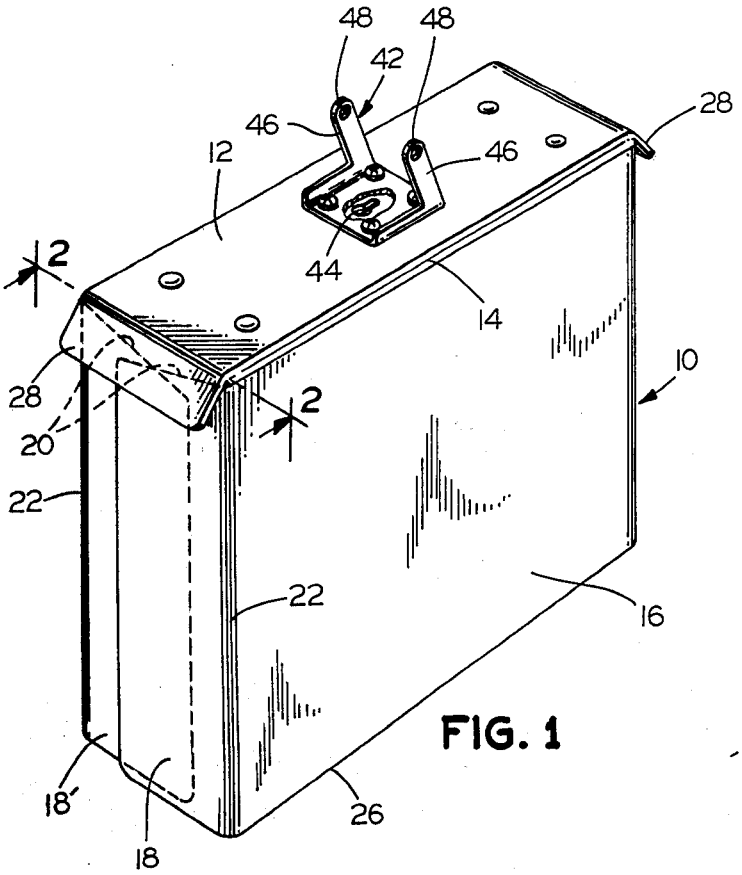
FIG. 1 is a perspective view of an assembly embodying the present invention.

Turning now in detail to the appended drawing, therein illustrated is a protective cover assembly embodying the present invention and including a cover member, generally designated by the numeral 10. The cover member 10 is integrally formed from a single sheet of synthetic resinous material, and consists of a spine 12 to which front and a rear cover are joined by integral "living" hinges 14 extending longitudinally therebetween. Both covers include a planar rectangular panel portion 16, and a pair of flanges 18, 18' at the opposite ends thereof. It will be appreciated that the construction is virtually the same at both ends; the flanges on the front and back covers are also virtually identical, the rear cover flanges 18' being so designated, however, because they are deformed to a slightly greater degree than are the flanges 18 of the front cover, thereby facilitating the necessary overlap. Generally, it will be convenient to deform the flanges 18 to a position which is substantially perpendicular to the panel 16, whereas the flanges 18' will form a slightly more acute angle with the rear panel 16 to which they are attached.

Figure 2:
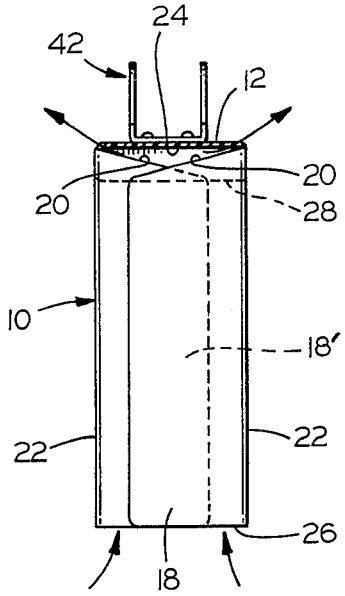
FIG. 2 is a sectional view of the assembly taken along line 2—2 of FIG. 1, drawn to a reduced scale and showing the shield piece in phantom line.

It is important to note that the inner edges 20 of flanges 18, 18' are inclined at an acute angle to the fold line 22, by which the flange is connected to the panel 16. As a result, in the overlapped position illustrated in FIGS. 1 and 2 openings 24 are formed beneath the spine 12 at the opposite ends of the assembly (the opening at one end being best illustrated in FIG. 2). These openings serve to facilitate ventilation of the cover member 10 by permitting air to circulate freely, passing through the open outer edge 26 and the end openings 24, as illustrated by the arrows shown in the same figure.

Projecting at approximately a 45° angle from each end of the spine 12 is a relatively short shield piece or tab 28, which is also integrally formed with the remainder of the cover member 10. As viewed in a horizontal plane, the shield pieces 28 traverse the corresponding openings 24, effectively covering them without interfering with the free flow of air therethrough.

Figure 3:
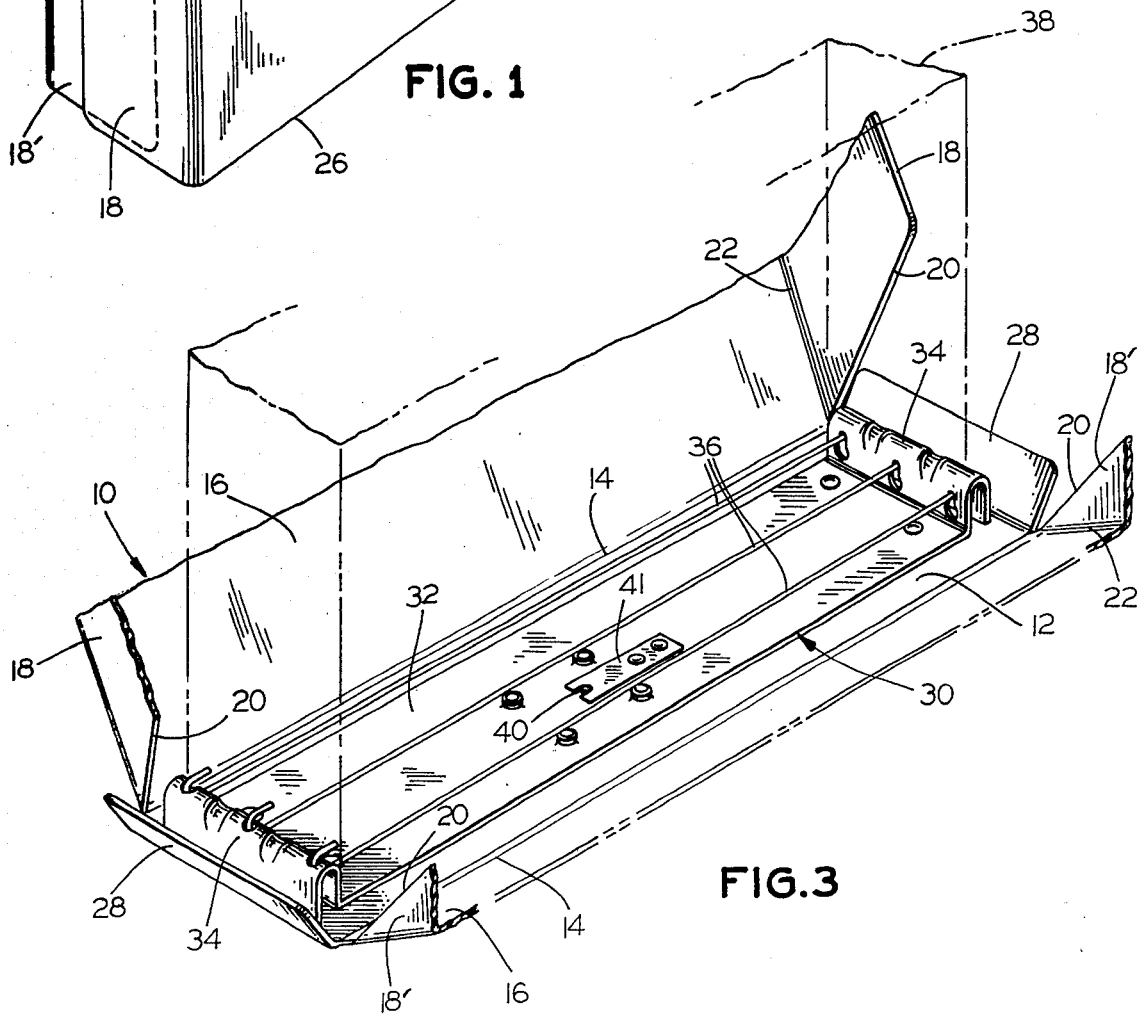
FIG. 3 is a fragmentary perspective view showing the interior of the assembly, drawn to an enlarged scale and showing a mounted directory in phantom line.

As is seen in FIG. 3, an elongated metal mounting fixture, generally designated by the numeral 30, is affixed within the cover member 10 against the inner surface of the spine 12, using rivets or like fasteners for the purpose. The fixture 30 consists of a generally rectangular base portion 32 and a pair of upstanding bracket pieces 34 at the opposite ends thereof. The bracket pieces 34 support a number of wire retaining members 36 which, in turn, serve to mount the directory 38 (shown in phantom line) with its spine in surface contact with the base portion 32 of the fixture 30. As will be appreciated, the wire retaining members 36 are disengageable from the bracket end pieces 34, so as to permit insertion and removal of the directory 38.

The fixture 30 has centrally located a key-hole slot 40 (only partially visible in FIG. 3), which is aligned with a similarly configured slot 44 formed in the spine 12 of the cover member 10, the slot 44 being visible through the broken-away section of the mounting bracket, generally designated by the numeral 42, which is affixed to the outer surface of the spine 12. The bracket 42 includes a pair of upstanding arms 46, which have aligned apertures 48 formed therethrough, the apertures being adapted to receive a mounting pin which is, in turn, received in a cooperating part secured to the supporting structure; this provides means for supporting the assembly. The aligned key-hole slots 40, 44 are adapted to receive a suitably configured end-piece of a cable or lanyard (not shown), providing second means of support, which end piece is secured in place by the spring clip 41; both support means are, of course, entirely conventional.

As indicated hereinabove, the cover member of the assembly will be fabricated from a single piece of thermoplastic sheet material, high density polyethylene being the resin of first choice. However, as will be apparent to those skilled in the art, other tough and durable plastic materials can be substituted, as long as they provide the requisite level of strength and protection, and are capable of being thermoformed to produce the necessary folds and living hinges. Typically, the sheet material from which the cover member is fabricated will be about 0.09 to 0.125 inch in thickness, depending of course upon the particular thermoplastic resin utilized and the properties desired in the final structure.

In addition to the modifications hereinbefore suggested, other changes can be made in the construction of the assembly without departing from the scope of the present claims. Thus, the internal mounting member certainly need not have the construction illustrated, albeit that it is highly desirable for use in combination with the cover member; for example, the hanger disclosed in U.S. Pat. No. 3,705,706 could be substituted for that shown, if so desired. The dimensions, configurations, and other features of the several parts of the cover member may also vary from those illustrated, consistent with the foregoing objects and description of the invention.

Thus, it can be seen that the present invention provides a novel protective cover assembly for a telephone directory or like volume, which is so constructed as to minimize the entry of rain and other forms of precipitation while, at the same time, providing good ventilation for the directory contained therewithin. The assembly affords a high degree of protection against abuse, and is itself tough and durable; it is also of rather simple design, and is relatively fascile and inexpensive to produce.

Having thus described the invention, what is claimed is:

1. A ventilated protective cover assembly for a telephone directory or the like, including: a one-piece cover member integrally formed from a sheet of relatively rigid thermoplastic material and comprised of a front cover, a rear cover, and a spine extending between said covers and hingedly connected thereto; and a mounting member affixed to said spine within said cover member and adapted to mount the directory therewithin, each of said covers comprising a panel portion dimensioned and configured to overlie a cover of the mounted directory, and a pair of flange portions disposed at the opposite ends of said panel portion, said flange portions at each end of said assembly extending toward one another from the associated panel portion, into overlapping relationship when said covers are in a closed position about the directory, to cooperatively overlie the top and bottom edges thereof, the inner ends of said cooperating flange portions being configured to define an opening adjacent each end of said spine for air circulation through said assembly, each of said flange portions being defined by (a) a fold line along which said flange portion is joined to said panel portion, (b) a shorter rectilinear leading edge extending generally parallel thereto, (c) an inner edge at said inner end extending at an acute angle to said fold line, and (d) an outer edge at the outer end thereof, said inner edges of said cooperating flange portions intersecting at points spaced from said spine to define said air flow openings in said closed position of said assembly, said spine having a shield piece projecting outwardly from each end thereof substantially over the adjacent one of said openings, said shield pieces preventing the direct entry of rain into the corresponding opening, without blocking the free flow of air therethrough.

2. The assembly of claim 1 wherein said shield pieces are substantially flat and project at about a 45° angle to the plane of said spine.

3. The assembly of claim 1 wherein said mounting member comprises an elongated fixture extending along said spine and presenting an abutment surface for the spine of the directory, said member also including at least one longitudinal retaining component secured to the opposite ends of said fixture for maintaining the directory against said abutment surface and within said cover member.

4. The assembly of claim 3 additionally including a hanger member secured to the outer surface of said spine for supporting said assembly from overlying attachment means.

5. The assembly of claim 1 wherein said material is a high density polyethylene, and wherein said flange portions, said shield pieces, and said hinges joining said covers to said spine are produced by deforming said sheet under heat and pressure.

* * * * *